United States Patent [19]

Wall et al.

[11] Patent Number: 4,852,489

[45] Date of Patent: Aug. 1, 1989

[54] SELF-INKING STAMPING DEVICE

[75] Inventors: Alexander C. Wall, Nokomis, Fla.; Leonard H. Sculler, Brunswick, N.J.

[73] Assignee: M&R Marking Systems, Inc., Cranford, N.J.

[21] Appl. No.: 122,127

[22] Filed: Nov. 18, 1987

[51] Int. Cl.[4] ..... B41K 1/40; B41F 31/24

[52] U.S. Cl. ..... 101/334

[58] Field of Search ..... 101/334, 333, 104, 105

[56] References Cited

U.S. PATENT DOCUMENTS

| | | | |
|---|---|---|---|
| 40,074 | 9/1863 | Beaumont | 101/333 |
| 78,446 | 6/1868 | Fessler | 101/334 |
| 405,704 | 6/1889 | Hill . | |
| 669,137 | 3/1901 | Dobbel . | |
| 827,347 | 7/1906 | Campbell . | |
| 1,025,019 | 4/1912 | Price | 101/334 |
| 1,042,766 | 10/1912 | Carleton | 101/334 |
| 1,121,940 | 12/1914 | Nagel . | |
| 1,345,255 | 6/1920 | Rushworth | 101/334 |
| 2,079,080 | 5/1937 | Melind | 101/334 |
| 2,312,727 | 3/1943 | Nisenson | 101/327 |
| 2,919,645 | 1/1960 | Leeds | 101/368 |
| 3,364,856 | 1/1968 | Lind | 101/334 |
| 3,402,663 | 9/1968 | Funahashi | 101/327 |
| 3,631,799 | 1/1972 | Funahashi | 101/327 |
| 3,952,653 | 4/1976 | McFarland | 101/327 |
| 3,988,987 | 11/1976 | Ikura et al. | 101/327 |
| 4,432,281 | 2/1984 | Wall et al. | 101/334 |

FOREIGN PATENT DOCUMENTS

| | | | |
|---|---|---|---|
| 197194 | 10/1986 | European Pat. Off. | 101/334 |

OTHER PUBLICATIONS

*Plastics Engineering Handbook*, "Taper or Draft", Third Edition, Copyright 1960, pp. 297-298.

*Primary Examiner*—Clifford D. Crowder
*Attorney, Agent, or Firm*—Albert C. Johnston

[57] ABSTRACT

A self-inking stamping device easily grasped and operated in a person's hand is provided by an improved arrangement of an encasing operating member relative to a frame member that supports an ink pad holder and contains an invertable type-carrying platen, with coacting means on the platen, the frame member and the operating member for disposing type of an elastic strip on the platen in inking position at an ink pad in the holder when the operating member is being held in a normal upward position by spring action and causing the type to impress evenly on a surface at the lower end of the frame member when the operating member is pressed downward to stamping position. Bridge members extending inward from an upper portion of an encasement wall of the operating member form a seat for a coiled spring compressed between them and an upper surface of the ink pad holder, and provide a space in-between them to receive and give access to an inking cup formation on the holder when the encasement wall is depressed. Cam slots formed in an end skirt of the platen at opposite sides of its axis of turnover movement cooperate with pins protruding inward from the frame member so as to position the platen accurately throughout its turnover movements and to keep its face perpendicular to the direction of platen displacement in the respective final portions of the upward and downward displacements.

7 Claims, 3 Drawing Sheets

SELF-INKING STAMPING DEVICE

This invention relates to an improved self-inking stamping device of a kind useful for quickly making ink impresions on documents, envelopes, container surfaces, or the like, by being grasped in a person's hand and positioned and pressed down by hand against a surface to be stamped.

Stamping devices of that kind have long been known. Various forms of such devices are disclosed, for instance, U.S. Pat. Nos. 405,704, 669,137, 827,347, 1,121,940, 2,079,080, 2,312,727, 2,919,645, 3,364,856, 3,402,663, 3,631,799, 3,952,653, 3,988,987 and 4,432,281.

The more recent U.S. Pat. No. 4,432,281 discloses a self-inking stamping device that has overcome a number of shortcomings of the previously known devices of like kind. The known form of that device, however, has left improvements yet to be desired. For instance, its size is greater than needed for many stamping uses, such, for example, as repeatedly imprinting a signature, a person's name and address, or a "confidential" or other brief designation on documents. Viewed economically, objectionable costs are involved in the manufacture of the device in that form, due to the number of different parts required and the processes required for assembling the parts into the complete stamping device.

The principle object of the present invention is to provide improvements of the self-inking stamping device of U.S. Pat. No. 4,432,281, by which such a device can be made simpler in construction and assembly with reduction of the manufacturing costs yet with retention and enhancement of the desirable features set forth in that patent.

According to this invention, such a simpler self-inking stamping device is provided which, for instance, is composed of a reduced number of parts that can be molded efficiently and assembled efficiently at reduced expense; it is quite easy to grasp and operate in a person's hand; holds the stamp-carrying platen desirably positioned at all times by the action of platen turn-over pins in cam slots formed in a skirt structure of the platen itself; and is quite easy to re-ink when need occurs, without risk of soiling one's fingers with ink.

The above-mentioned and other objects, features and advantages of the invention will be further evident from the accompanying drawings and the following detailed description of an illustrative embodiment of the invention. In the drawings.

Figure 6:
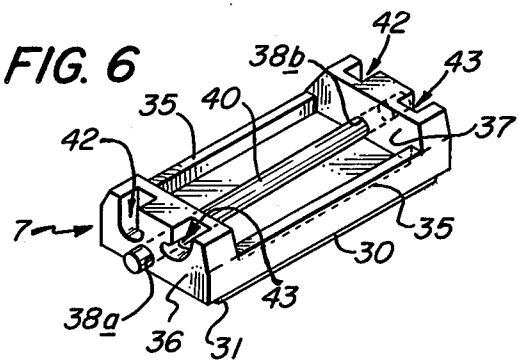
FIG. 6 is a perspective view of the stamp-carrying platen and the axle of the device.

The stamping device as shown in the drawings comprises an upright hollow frame member 1 having an open lower end at 2 to bear against a supporting surface indicated at 3. An upper, operating member 4 interfits with and is displaceable vertically relative to the frame member 1. Spring means in the form of a helically coiled wire spring 5 under compression normally holds the operating member in an upward position from which by one's hand it can be thrust downward relative to the frame member 1 to a stamping position.

An ink pad holder 6 containing an ink pad 9 is supported by the frame member 1 at a distance above the open lower end 2. A displaceable type-carrying platen 7 is located inside the frame member in the space between its lower end and the ink pad 9, and coating means 8 having parts connected respectively with the platen 7, the frame member 1 and the operating member 4 are provided for disposing the platen in an inking position at the ink pad holder 6 when the operating member is in its normal, upward position and disposing the platen in an inverted position to stamp an inked impression onto a surface 3 at the lower end of the frame member when the operating member is depressed to stamping position.

The operating member 4 comprises an upright wall **4*a* forming a hollow encasement that surrounds the frame member and has a closure 4*b* fitted removably onto its top. Each of the parts 1, 4*a* and 4*b*** preferably is made in one piece as a suitably rigid and durable molding of a resilient plastic material such, for example, as an acrylonitrile-butadiene resin known as ABS.

Figure 7:
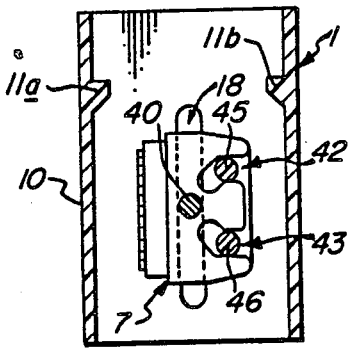
FIGS. 7, 8, 9, 10, 11 and 12 are schematic views showing several positiosn of the platen relative to its axis of turn-over movement as caused by engagement of its cam slots with platen-positioning pins, which occur in the course of displacement of the platen between its position shown in FIG. 4 and its stamping position.
Figure 8:
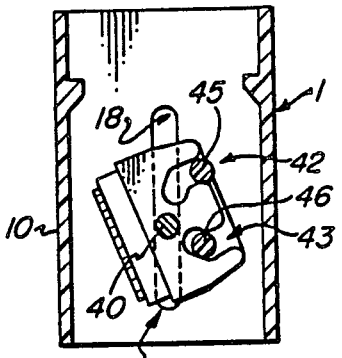
Figure 9:
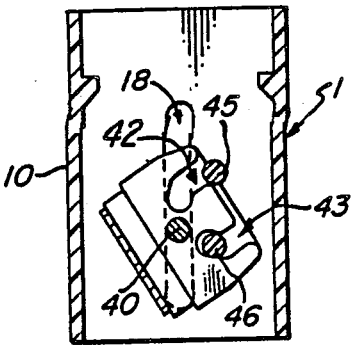
Figure 10:
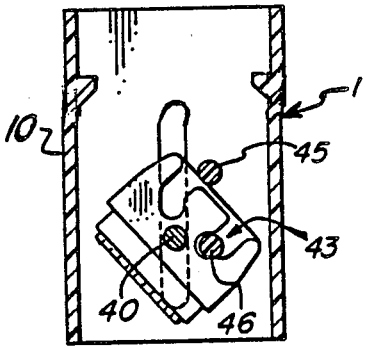
Figure 11:
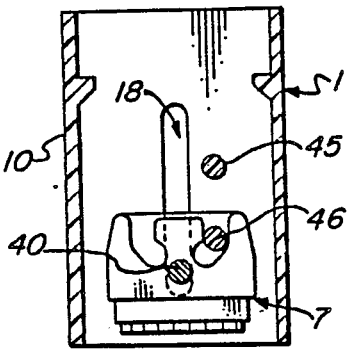
Figure 12:
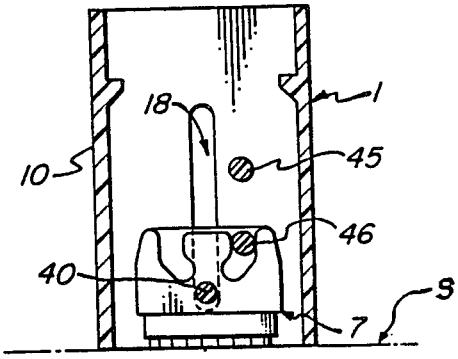

The frame member 1 is a substantially straight upright rectangular box structure 10 which is open at both its bottom and its top as shown in FIG. 7. Ledges **11*a* and 11*b* protrude inwardly from opposite walls of the box structure 10 at a location spaced below but near its open top. These ledges provide a firm support on which the ink pad holder 6** is seated simply by being placed into the open top of the box.

The ink pad holder 6, as shown in FIGS. 1–5, is a tray-like structure of elongate rectangular form which comprises a rigid backing 20 having side walls 21 and end walls 22, for holding an ink absorbent pad 9 in downwardly faced position between the ledges **11*a* and 11*b*. The backing 20 is formed with at least one upwardly protruding portion 23 which forms a pocket 24 wider that it is deep and opening downward into the space occupied by the ink pad 9. The pocket 24 is filled with an ink receptive material, for instance a disc or pad 24*a* of felt, which aids distribution of ink from the pocket into the main body of the ink pad 9. The part of the backing portion 23 overlying packet 24 has a small opening 25, for instance a hole of about 2 to 3 mm. in diameter, leading through it for conducting ink into the pad 9** via the pocket.

The backing portion 23 also has thereon an upwardly open cup formation 26 which surrounds the inking opening 25 and can receive a limited quantity of ink for dissemination into the ink pad 9. When the closure **4*b* is removed from the encasement 4*a*, the cup formation on the ink pad holder is accessible from a location above the frame member 1, as described more particularly hereinafter. The cup formation 26 is made to hold only a few drops of the ink required for the ink pad of the stamp. When the ink pad 9 needs to be inked, one can deliver ink drop by drop into the cup at 26 until the cup is nearly full, and the ink then will drain through the hole 25 into the felt pad 24***a* in the pocket 24, from which ink disseminates into the main body of the ink pad 9.

After several such fillings of the cup 26, the felt pad in the pocket becomes saturated and ink will stand in the cup. This condition is a signal that the re-inking is sufficiently complete. It occurs when upper regions of the ink pad 9 are saturated, and before too much ink reaches the lower pad region engaged by a stamp on the platen 7. When this signal is observed, one can cease adding ink and ink standing in the cup 26 will then seep gradually toward the ink pad without over-inking it.

Figure 1:
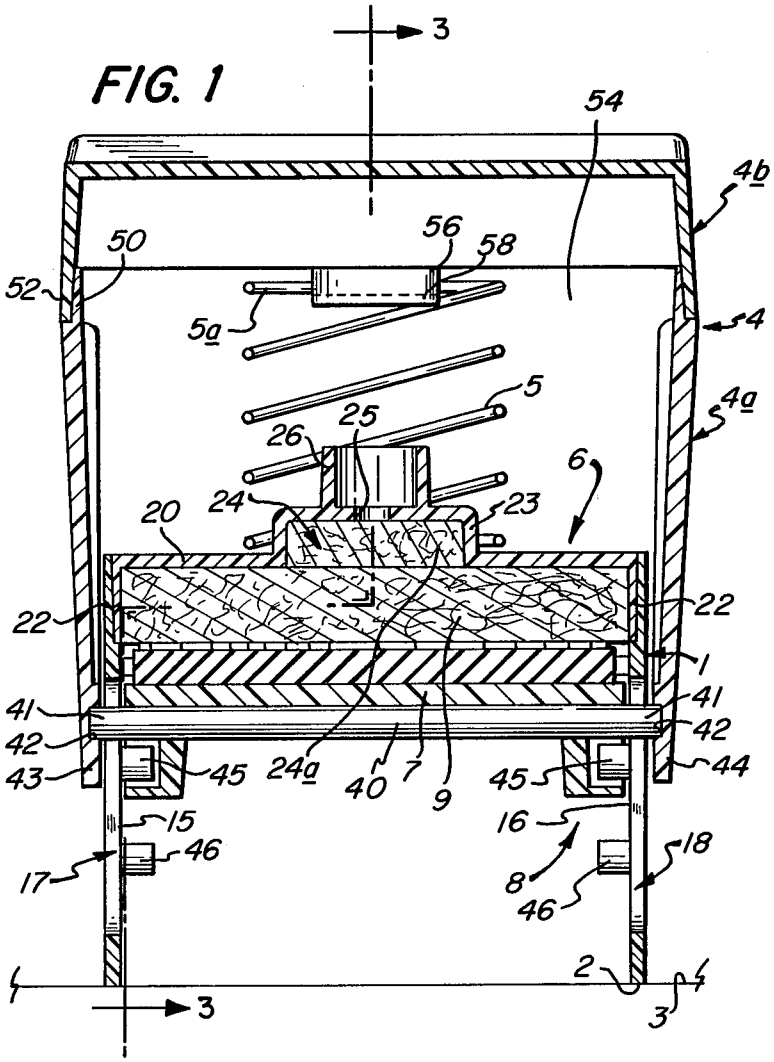
FIG. 1 is a longitudinal vertical cross-sectional view on an enlarged scale of a self-inking stamping device embodying the invention.
Figure 3:
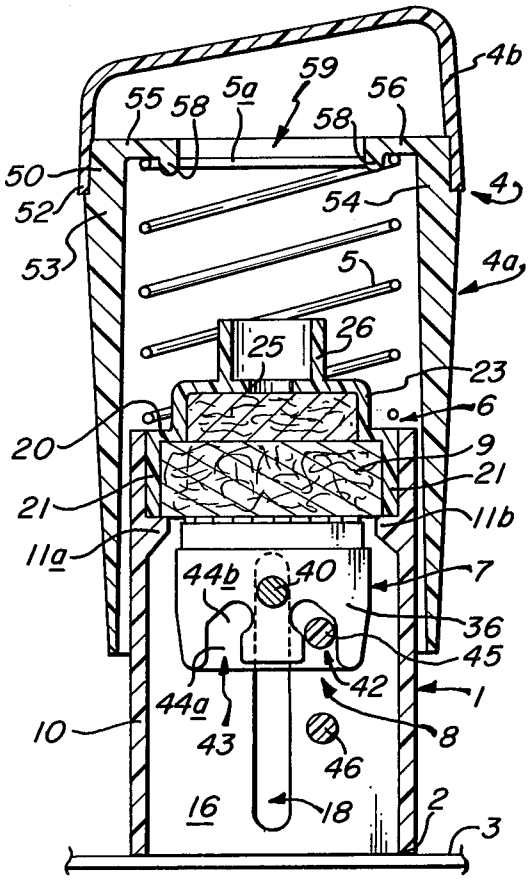
FIG. 3 is a transverse cross-sectional view of the device, taken along line 3—3 in FIG. 1.

The type-carrying platen 7 normally is disposed in an upward position, as shown in FIGS. 1 and 3, where the raised letters or information characters 32 on a rubber type strip 31 or the like fixed to the face plate 30 of the platen are held in an inking position at the face of the ink pad 9 in holder 6. The platen is movable from that upward or inking position to an inverted, stamping position at the lower end of the frame member 1, where the type characters on the platen will impress against a surface 3, by the action of the mechanism generally indicated at 8, which is operated by downward movement of the operating member 4 relative to frame member 1 against the force of the spring 5. This spring force returns the parts to the upper, type-inking position when the operating member 4 is release from downward pressure.

The platen itself (see FIGS. 1 and 6) comprises not only the face plate 30 on which a strip bearing type to be stamped is carried but also stiffening skirts walls 35 along opposite sides thereof and end skirts 36 and 37 which protrude farther from the plate 30. The end skirts are formed with coaxial bores 38*a* and 38*b* which serve as bearings for an axle rod 40 that extends centrally along the underside of the face plate 30.

Opposite end portion of the axle rod 40 extend from the platen coaxially and freely through vertically elongate slots 17 and 18 in opposite end walls 15 and 16 of the frame member 1, and terminate in rod ends 41 which are seated in sockets 42 (FIG. 2) formed in opposite lower end portions 43 and 44 of the operating member's encasement wall 4*a*. The axle rod 40 thus constitutes a pivotal support about the axis of which the platen can be turned while it is being carried downward or upward by the rod with each displacement of the operating member 4 relative to the frame member 1.

Each end skirt 36 or 37 of the platen 7 has a pair of cam slots 42 and 43 formed in it at opposite sides of the axis of turning movement of the platen about the rod 40. The cam slots of each pair open laterally outward from the related end skirt and are arranged to cooperate with respective upper and lower platen positioning pins 45 and 46 that protrude inward from the adjacent frame member wall 15 or 16. The pins 45 and 46 of each set are spaced apart vertically and lie in a plane spaced to one side of the path of movement of the rod 40 with the operating member encasement 4*a*. The related cam slots 42 and 43 are so formed and arranged that they will engage successively with the pins 45 and 46 in a manner causing the platen 7 to be inverted in the course of, yet to be positioned definitely throughout each downward and each upward displacement of the operating member 4 relative to the frame member 1.

More particularly, each of the cam slots 42 and 43 consists of a pin entry slot portion 44*a* extending substantially perpendicular to the face of platen plate 30 and a slot foot portion 44*b* extending toward the turning axis of the platen at an obtuse angle to the pin entry portion. Because the cam slots are formed in an outer portion only of the end skirt 36 or 37, inner portions of which hold the platen on the axle rod 40, the slot foot portions 44*b* can extend nearly, or even completely if desired, to the location of the axle rod. As a result, quite a short radius is provided for turning movement of the platen about the rod axis.

The bordering side walls of each slot 42 and 43 are rounded at the mouth, the angle and the base of the slot and are formed precisely so that no appreciable play can occur laterally between those walls and a pin 45 or 46 received in the slot.

As a result of the form and the location of the cam slots relative to the pins 45 and 46 and theplaten axis at rod 40, the angular position of the platen 7 is at all times under positive control by at least one of the pins. Moreover, the cooperation of the pins and the slots is such that in the course of each downward displacement of the operating member 4 the platen becomes completely inverted by the turning action of cam slot 43 about the lower pin 46 before the platen reaches its stamping position, so that the entry slot portion 44*a* of slot 43 holds the platen face perpendicular to the direction of platen displacement during the final stage of movement of the platen to the stamping position. Similarly, by the turning action of cam slot 42 about the upper pin 45 the platen becomes completely inverted before reaching its inking position at ink pad 9, so that the entry slot portion 44*a* of slot 42 holds the platen face perpendicular to the direction of platen displacement during the final stage of movement of the platen to its linking position.

Figure 2:
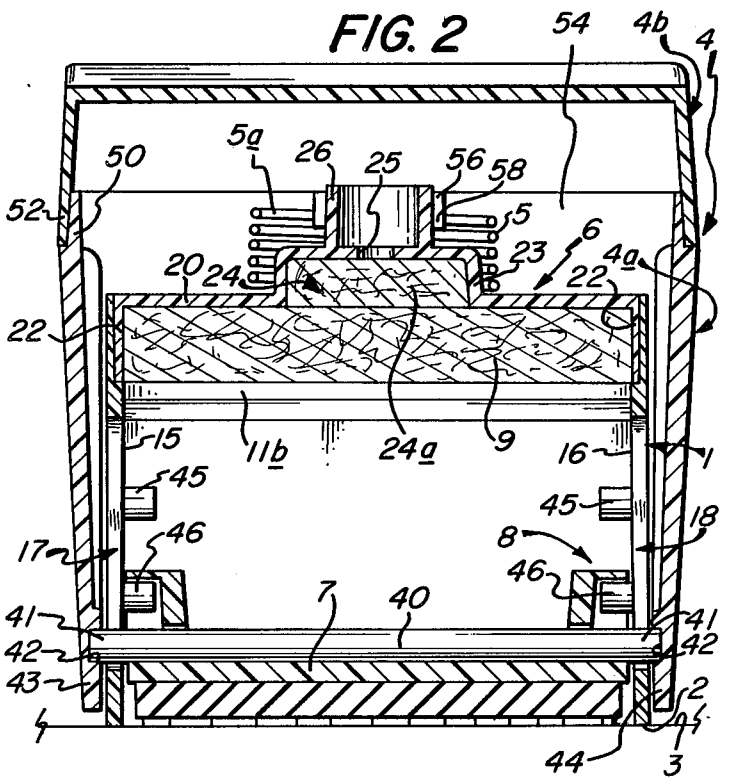
FIG. 2 is a corresponding view thereof, showing the device in stamping position.
Figure 5:
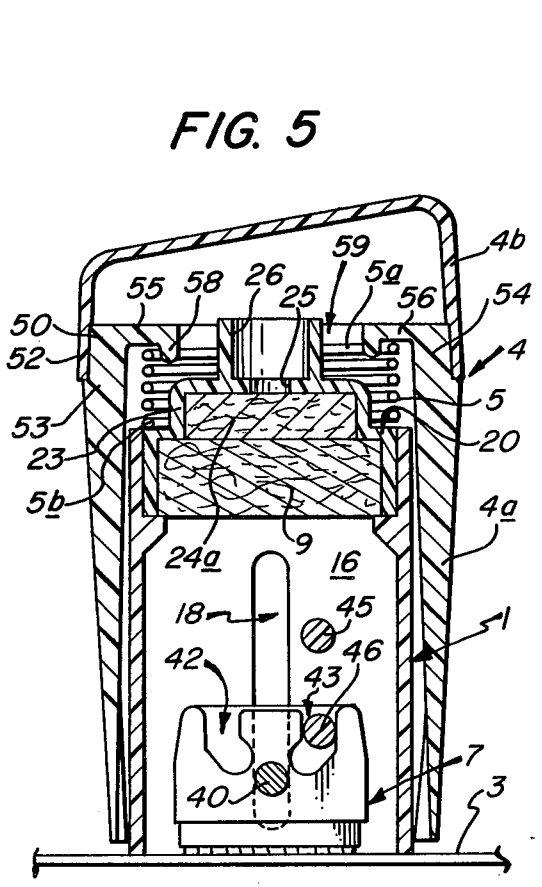
FIG. 5 is a view similar to that of FIG. 4 but showing the parts in stamping position.
Figure 4:
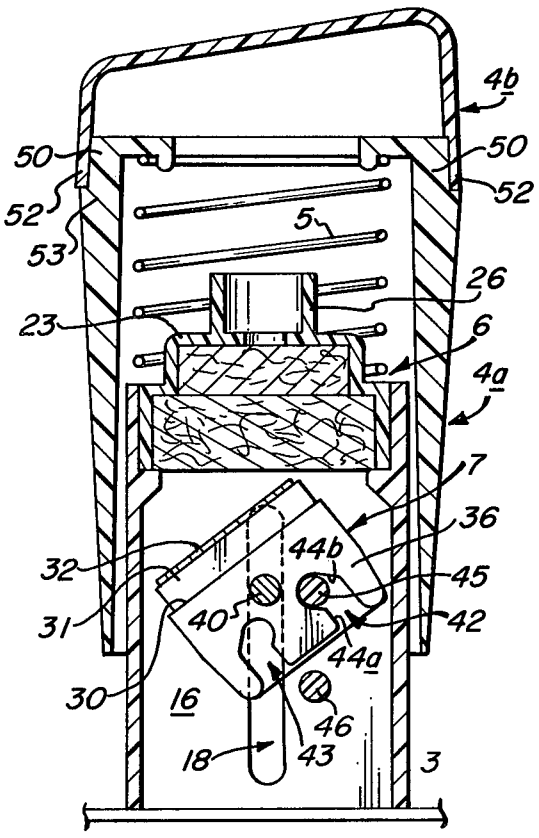
FIG. 4 is a view similar to that of FIG. 3 but showing the parts in a position that occurs as the stamp-carrying platen is moved away from the inking pad.

FIGS. 1 and 3 of the drawings show relative positions of the parts of the improved stamping device in their idle, or type inking, position. FIGS. 2 and 5 show their relative positions in the downward, or stamping, position. FIG. 4 shows a partial downward position in which the face of platen 7 is turned about the axis of rod 40 to an angle of about 45° by action of the foot portion 44*b* of cam slot 42 against the upper pin 45. FIGS. 7–12 schematically show further downturned positions of the platen, including a mid-stroke position, FIG. 7, in which the pins 45 and 46 are symmetrically disposed in their respective cam slots; a further downturned position, FIG. 8, in which the upper pin 45 is in the mouth of its slot 42; still further positions, FIG. 9 and FIG. 10, in which the upper pin is well outside its slot and the platen position is controlled by the lower pin 46 in the foot portion of its cam slot 43; a 180° turn-over position, FIG. 11, in which pin 46 and entry portion 44*a* of slot 43 hold the platen face parallel to the plane of the lower end of frame number 1; and a stamping position, FIG. 12, in which impression indicia on the plate are pressed against a surface S to be stamped. Relative positions corresponding as mirror images to those shown in FIGS. 8–12 occur in the platen displacement between the mid-stroke position of FIG. 7 and the linking position of FIGS. 1 and 3.

As may be seen in FIGS. 1–5, the hollow encasement wall 4*a* surrounding the frame member 1 has at its top a rim section 50 which fits inside and holds in place a merging skirt portion 52 of the top closure 4*b* so that the closure is removably engaged onto the upper end of the encasement.

According to another feature of the invention, the front and rear panels 53 and 54 of wall 4*a* have fixed to their upper portions, as by being molded integrally with the rim section 50, inwardly protruding members 55 and 56 which extend each toward the other as bridges over the space inside wall 4*a* (FIGS. 3–5). The bridge members form seat for an uppermost coil 5*a* of the spring 5, which bears under compression against their undersides. Each of the bridge members preferably is formed with a downturned lip 58 on its inner end to engage inside the coil 5*a* and to keep it securely in place. The lower end 5*b* of the coil spring (FIG. 5) bears against the backing 20 of the ink pad holder 6 and surrounds upwardly protruding portion 23 thereof so that the lower spring end too is kept securely in place.

The molding of the bridge members 55 and 56 integrally with wall 4*a* is achieved by designing the front and back panels 53 and 54 with vertical draft angles, as seen in FIGS. 3–5, which enable the entire molded piece to be removed from the mold that forms it by simple movement of one mold part directly away from another.

As shown in FIGS. 3–5, the bridge members 55 and 56 are sufficiently spaced apart so that their inner ends provide between them an open space 59 into which the cup formation 26 of the ink pad holder protrudes when the operating member is depressed to stamping position. Inking of the ink pad 9 can be effected whenever desired simply by removing the closure 4*b*, pressing the encasement 4*a* down to stamping position (FIG. 5), and applying ink from a dropper inside the cup at 26. Consequently, there is little or no risk of spilling ink or soiling one's fingers with the ink when introducing ink for the ink pad of the stamping device.

It will be evident from the foregoing description and the drawings that the improved self-inking stamping device requires fewer parts than its antecedent. Further, its parts can be assembled into the operative stamping device by a relatively simple and economical process. The frame member 1 being positioned upright on a work table, the platen and axle rod assembly of FIG. 6 can be placed face down in the frame member with the rod ends protruding through the slots 17 and 18. Then the ink pad holder 6, with its pad 9 and disc 24*a* in place, is placed into the upper end of the frame member and the spring 5, uncompresed, is then placed upright onto the holder 6. Then the encasement 4*a* is moved down over the spring and the frame member until the opposite lower wall portions 43 and 44 of the encasement, by movement of their edges onto suitable wedges, are spread apart elastically so as to pass over the axle rod ends 41 and bring the sockets 42 into position for engaging with the rod ends upon removal of the wedges. In the course of the downward assembly movement of the encasement its bridge members 55 and 56 first engage against the upper coil 5*a* of the spring 5 and then compress the spring to a desired extent as the movement continues.

An assembled device is thus obtained which, with its ink pad suitably inked, its top closure 4*b* in place, and a desired resilient type strip applied to the face of its platen 7, can be grasped and operated easily in a person's hand and will serve for making indefinitely great numbers of accurately stamped impressions of the type characters of the strip by simply placing the open lower end of the frame member against surfaces to be imprinted and pressing the encasement 4 downward.

It will be understood that the new features of the invention disclosed herein are intended to be defined by the appended claims and that they can be utilized in other forms and ways without limitation to particulars of the illustrative embodiment except as may be required for fair construction of the claims.

What is claimed is:

1. In a stamping device comprising an upright hollow frame member having an open lower end to bear against a supporting surface, an operating member comprising a hollow encasement interfitting with and displaceable vertically relative to said frame member and a top closure fitting removably onto the upper end of said encasement, spring means normally holding said encasement in an upward position from which by one's hand it can be pressed downward relative to said frame member to a stamping position, an ink pad holder supported by said frame member at a distance above said lower end, ink receiving means on the upper side of said holder for receiving and delivering ink for inking a pad in said holder, a displaceable type-carrying platen inside said frame member, and coacting means connected respectively with said platen, said frame member and said encasement for disposing said platen in an inking position at said holder when said encasement is in said upwrd position and disposing said platen in position to impress a surface at said lower end when said encasement is depressed to stamping position, said encasement comprising an upright wall outside and extending above said frame member and having spring seating means fixed to opposite upper end portions of opposite panels of said wall, said spring means being compressed between said ink pad holder and said seating means, the improvement wherein said spring seating means comprises separate ridge members protruding inward each toward another from said opposite upper end portions and each terminating at a free inner end spaced away from the inner end of the other, said opposite panels being divergent in downward direction from said bridge members to the lower end of said wall, said ink receiving means being accessible in the space between said bridge members upon removal of said top closure and depression of said encasement to stamping position, and said spring means comprises a coiled spring having an upper coil thereof being against the undersides of and spanning the space between said bridge members.

2. A stamping device according to claim 1, said bridge members being molded integrally with said opposite upper end portions, said bridge members each having on its inward end a downturned lip to engage inside said upper coil.

3. A stamping device according to claim 1 or 2, and wherein said ink receiving means comprises an upwardly open cup formation protruding upward from said holder and opening downward therethrough for receiving drops of ink and passing the ink toward an ink absorbent pad in said holder.

4. In a stamping device comprising an upright hollow frame member having an open lower end to bear against a supporting surface, an operating member interfitting with and displaceable vertically relative to said frame member, spring means normally holding said operating member in an upward position from which by one's hand it can be pressed downward relative to said frame member to a stamping position, an ink pad holder supported by said frame member at a distance above said lower end, a displaceable type-carrying platen inside said frame member, and coacting means connected respectively with said platen, said frame member and said operating member for disposing said platen in an inking position at said holder when said operating member is in said upward position and disposing said platen in position to impress a surface at said lower end when said operating member is depressed to stamping position;

the improvement wherein said coacting means comprise platen support means carried by opposite lower wall portions of said operating member and extending coaxially therefrom through vertically elongate openings in said frame member and into skirt means integral with said platen, said platen being carried by and rotatable about the axis of said support means;

upper and lower platen positioning pins in a pair thereof spaced apart vertically on and protruding inward from at least one side of said frame member, each pair of said pins lying in a plane spaced to one side of the path of movement of said support means with said operating member;

and in a said skirt means at least at one end of said platen a pair of angled cam slots disposed at opposite sides of said axis and respectively opertive to receive and engage successively with said pins of sa said pair so as to definitely position said platen about said axis throughout each downward and each upward displacement of said platen with said operating member, said cam slots each comprising a pin entry slot portion extending substantially perpendicular to the face of said platen and a slot foot portion extending toward said axis from an at an obtuse angle to said entry position; one of said entry slot portions cooperating with the lower pin of a said pair to hold said platen face perpendicular to the direction of displacement of said platen during a final stage of each movement of said platen to said stamping position.

5. A stamping device according to claim 4, the other of said entry slot portions cooperating with the upper pin of a said pair to hold said platen face perpendicular to said direction of displacement during a final stge of each movement of said platen to said linking position.

6. A stamping device according to claim 4 or 5, each said pair of cam slots being formed in a portion of the said platen skirt means outside an uninterrupted portion thereof supported on said platen support means.

7. A stamping device according to claim 4 or 5, said platen support means comprising an axle rod extending through said platen skirt means and said frame member openings and having its ends seated in sockets formed in said opposite lower wall portions of said operating member, each said pair of cam slots being formed in a portion of sid platen skirt means outside an uninterrupted inner portion thereof supported on said axle rod, said slot foot portions terminating at locations close to said rod.

* * * * *